US005284363A

United States Patent [19]

Gartner et al.

[11] Patent Number: 5,284,363

[45] Date of Patent: Feb. 8, 1994

[54] MULTI-LAYER HINGED LABEL

[75] Inventors: Gerald J. Gartner, Hollis; Paul Cote, Wilton; Michael S. Kelley, Hollis, all of N.H.

[73] Assignee: Gar-Doc, Inc., Milford, N.H.

[21] Appl. No.: 745,446

[22] Filed: Aug. 15, 1991

[51] Int. Cl.[5] ..... B42D 15/00

[52] U.S. Cl. ..... 283/81; 283/101

[58] Field of Search ..... 283/81, 94, 98, 99, 283/101, 105, 110; 428/40–43

[56] References Cited

U.S. PATENT DOCUMENTS

| | | | |
|---|---|---|---|
| 4,068,028 | 1/1978 | Samonides . | |
| 4,512,845 | 4/1985 | Kobler . | |
| 4,592,572 | 6/1986 | Instance . | |
| 4,744,161 | 5/1988 | Instance . | |
| 4,744,591 | 5/1988 | Instance . | |
| 4,771,891 | 9/1988 | Sorensen et al. . | |
| 4,940,640 | 7/1990 | Skees | 283/81 X |
| 4,964,512 | 10/1990 | Ingram et al. . | |
| 4,964,513 | 10/1990 | Ingram et al. . | |

FOREIGN PATENT DOCUMENTS

| | | |
|---|---|---|
| 2154539A | 2/1984 | United Kingdom . |
| 2154506 | 9/1985 | United Kingdom . |
| 2212474A | 11/1987 | United Kingdom . |
| 2223476A | 8/1988 | United Kingdom . |
| 2192605 | 10/1990 | United Kingdom . |

*Primary Examiner*—Mark Rosenbaum
*Assistant Examiner*—Willmon Fridie, Jr.
*Attorney, Agent, or Firm*—James R. Laramie

[57] ABSTRACT

A multi-layer label for displaying information is disclosed which includes at least two layers which may be repeatedly partially separated and re-adhered to one another, such that a portion of the outer surface of a lower layer is exposed upon separation of a portion of an upper layer from it. The inner surface of the upper layer of the label is coated with a pressure sensitive adhesive. To form a lift tab for the upper layer at least one corner of the inner surface is either coated with varnish to deaden the adhesive, or alternatively, a corner is not coated with adhesive. The outer surface of the lower layer is selectively coated with an adhesive release material such that the coated portion releasably bonds to the inner surface of the upper layer, and, the portion of the outer surface of the lower layer not coated with the adhesive release layer permanently bonds to the upper layer thus forming a hinge between the two layers. A method and apparatus for manufacturing a multi-layer label is also disclosed.

37 Claims, 7 Drawing Sheets

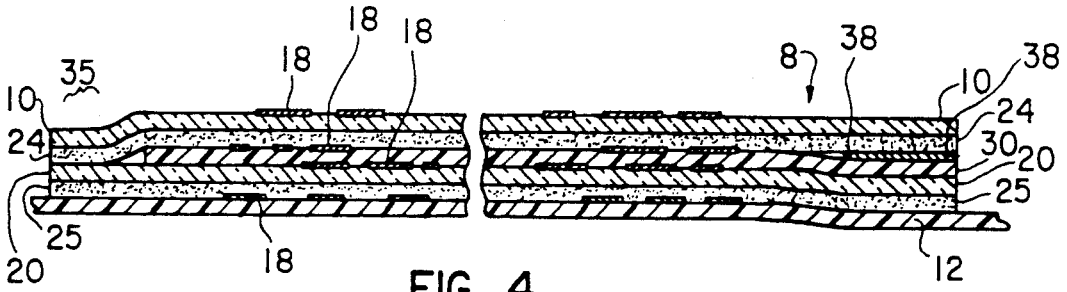
FIG. 4
FIG. 5A
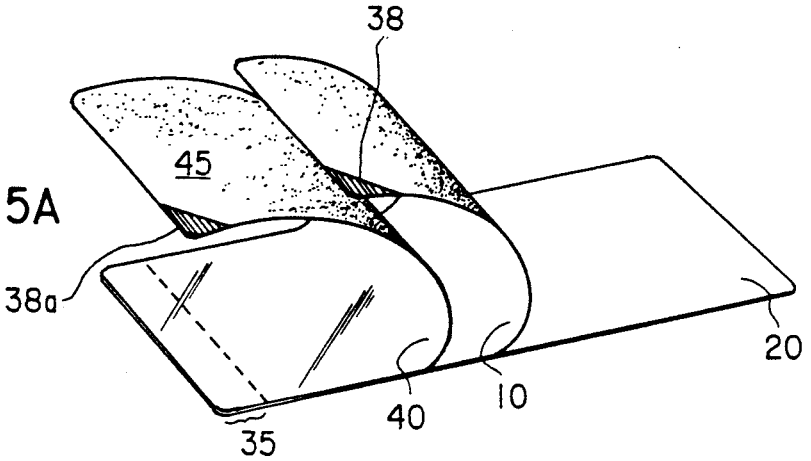
FIG. 6
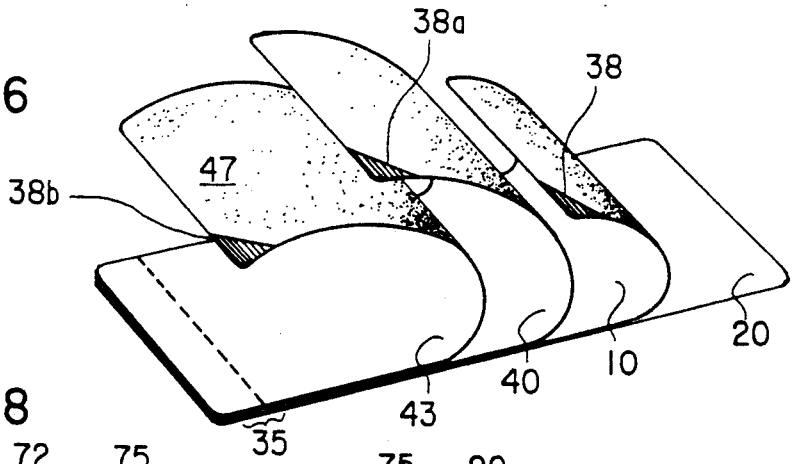
FIG. 8
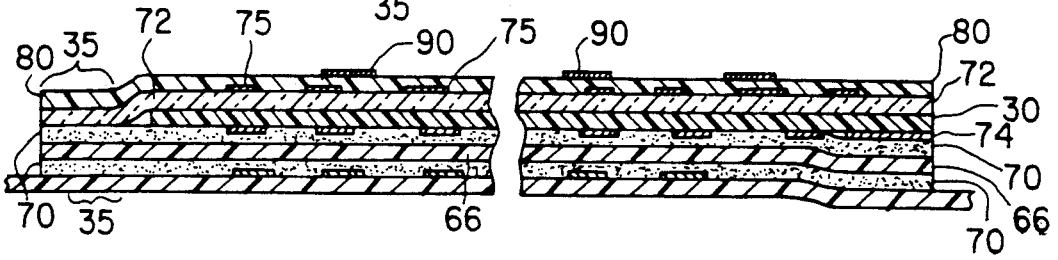

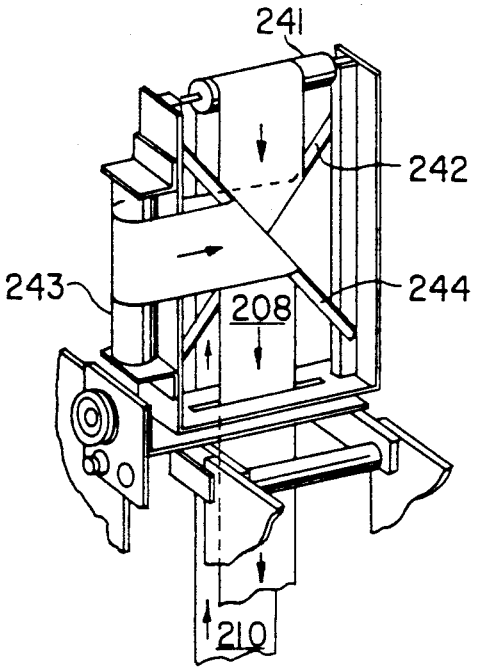
FIG. 10
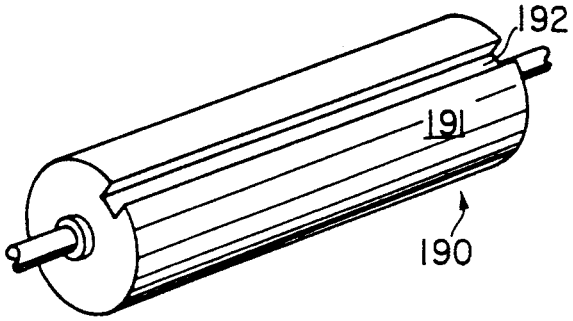
FIG. 11
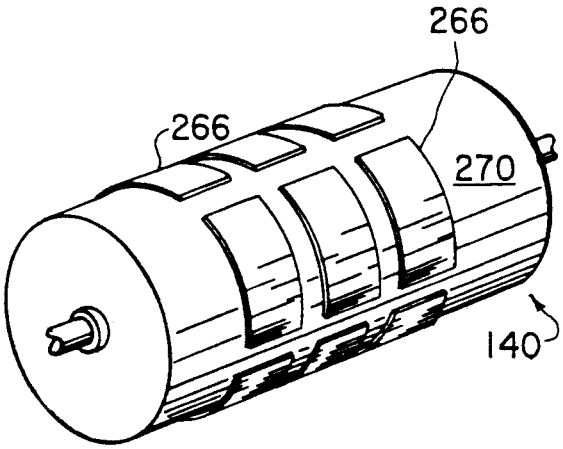
FIG. 12
FIG. 7
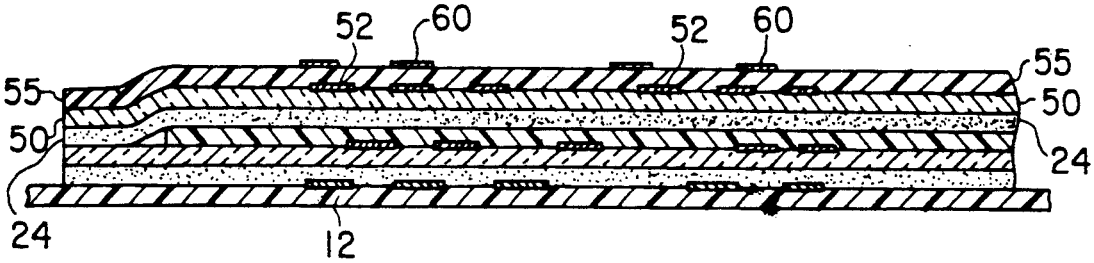

MULTI-LAYER HINGED LABEL

BACKGROUND OF THE INVENTION

1. Field of the Invention

The present invention relates to a multi-layer or multi-page label formed from a plurality of label layers and a method and apparatus for printing information on a plurality of label layers and for laminating the layers to form a hinged label which is securable to, for instance, an article of manufacture.

More particularly, the invention relates to a multi-layer label that is constructed in such a manner as to allow an outer layer to be partially and repeatedly separated from an underlying layer to expose a portion of the underlying layer.

2. Description of Related Art

A number of multi-page separable and re-adherable hinged labels are known. For instance, United Kingdom Published Patent Application Nos. 2,223,476 and 2,212,474 A and U.S. Pat. Nos. 4,592,572 and 4,744,161 each disclose labels which have been produced as a multi-page label for use on an article of manufacture where the fold in a folded single label piece defines the hinge of the label. In the manufacturing process of these labels, an adhesive is selectively applied to a predetermined portion of the label, such as along one of the pages thereof, thus allowing the label to be permanently bonded to the article of manufacture. A second, predetermined area or page is coated with adhesive to facilitate a releasable bond with another area or page, thereby allowing the label to be peeled open, read and later re-sealed to a closed position. The manufacturing process of these known labels includes a number of label folding, printing and other processing steps in order to facilitate manufacture of the label that may make label fabrication unduly complex. A further example of a complex label configuration and fabrication procedure is disclosed, in U.S. Pat. No. 4,592,572, in which the label is folded at least three times in order to form the multipage label. Likewise, in U.S. Pat. No. 4,744,161, the label is folded in at least two places along a single sheet in order to form the multipage label. Further, after opening and reading the printed matter printed on the label, the multiple folds make the task of reclosing the label difficult. In U.S. Pat. No. 4,744,161, a first folded portion of the label is selectively coated with an adhesive release material. A second portion of the label is selectively coated with adhesive. The adhesive coated portion co-acts with the adhesive release coated portion such that the two label portions may be separated and re-adhered repeatedly. However, a deficiency of this design is the degree of care that must be expended upon label closure to ensure accurate folding of the first portion and alignment of the adhesive with the release material.

An alternate arrangement was made upon the concept of having a multi-page label in United Kingdom Patent Application No. 2,154,539, in which two separate label layers are joined together to form a two page label that does not include any folds. In order to form the multipage label, a first region of an upper layer is coated with a permanent adhesive to form a permanent bond between the upper layer and a second layer. Spaced apart from the first region of the upper layer is a second region that is coated with a releasable adhesive. The second layer is coated with a release material which co-acts with the releasable adhesive to allow the upper layer to be repeatedly peeled away from the lower layer and re-adhered thereto. When the upper layer is separated from the lower layer in the foregoing manner, printed material on the second layer becomes exposed. However, there are a number of disadvantages to this arrangement which are similar to those mentioned above. One disadvantage is that selective printing of information and the application of two separate regions of adhesive is costly and requires precision in manufacture. In addition, when coating the label with adhesive, care must be taken to align the two separated adhesive regions with the area of the label containing the printed matter. Further, as with previous arrangements, considerable care must be taken to ensure proper layer alignment upon label re-closure. If the adhesive on the upper layer does not align with the adhesive release material on the lower layer, the upper layer may permanently bond to the lower layer in the area having printed matter, thus making re-opening of the label difficult, if not impossible.

SUMMARY OF THE INVENTION

In the various embodiments of the present invention, the above-mentioned difficulties and problems are overcome.

The invention relates to a multi-layer label having information printed thereon. In one embodiment of the present invention, first and second sheet-like label layers are laminated together. The first layer has an inner surface coated with adhesive and an outer surface partially coated with an adhesive release material, thus forming coated and uncoated portions. The second sheet-like layer has an inner surface substantially entirely coated with a pressure-sensitive adhesive. The second layer is superposed upon the first layer such that the inner surface of the second layer contacts the outer surface of the first layer. A releasable bond thus forms between the adhesive on the inner surface of the second layer and the adhesive release material on the outer surface of the first layer which permits the second layer to be repeatedly separated from the coated portion of the first layer. A more permanent bond forms between the uncoated portion of the first layer and a corresponding region of the inner surface of the second layer to provide a hinge between the two label layers. Both surfaces of either layer may include printed information.

The invention also relates to a method and apparatus for manufacturing multi-sheet labels in a substantially continuous process in which the following steps are performed:

(a) providing a first elongated web of material having a first surface coated with adhesive material;

(b) providing a second elongated web of material having printed matter thereon and an adhesive release material selectively coating a first portion of at least one surface, while a second portion of the surface remains uncoated;

(c) superposing the webs together such that at least a portion of the first surface of the first web substantially permanently bonds to the uncoated portion of the surface of the second web to form a composite web; and (d) cutting the composite web into a plurality of hinged labels such that the bond between the uncoated portion of first surface of first web and of the second web defines a hinge and the first coated portion of the second web and the first web are repeatedly separable from one another and are selectively re-adherable. In a preferred aspect of the invention, the foregoing steps are performed sequentially in the manner recited.

BRIEF DESCRIPTION OF THE DRAWINGS

The invention, as to its organization and method of operation, together with the advantages thereof, will best be understood by reference to the following specification taken in connection with the accompanying drawings and reference numerals, in which:

FIG. 4 is a sectional side view of the label shown in FIG. 1;

FIG. 5A is a top perspective view of an alternative embodiment of the present invention comprising three laminated layers, shown in a partially open position;

FIG. 6 is a top perspective view of yet another embodiment of the present invention, wherein the label is provided with four laminated layers, shown in a partially open position;

FIG. 7 is a sectional side view of yet another alternative embodiment of the label of the present invention;

FIG. 8 is a sectional view of a further alternative embodiment of the label of the present invention;

FIG. 10 is a perspective view of a web turnover bar employed in the apparatus shown in FIG. 9A;

FIG. 11 is a perspective view of a printing roller employed by the printing apparatus shown in FIG. 9A for selective printing;

FIG. 12 is a perspective view of a die cutter employed by the apparatus depicted in FIGS. 9B.

DETAILED DESCRIPTION OF THE PREFERRED EMBODIMENTS

A. THE LABEL

Figure 1:
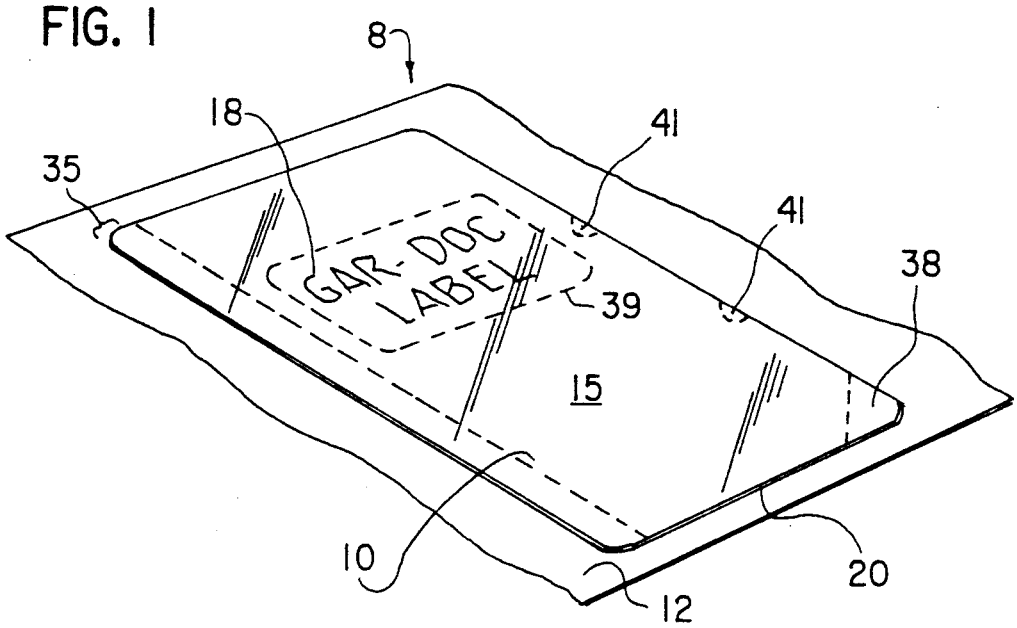
FIG. 1 is a top perspective view of the label constructed in accordance with the features of a first embodiment of the present invention.
Figure 2:
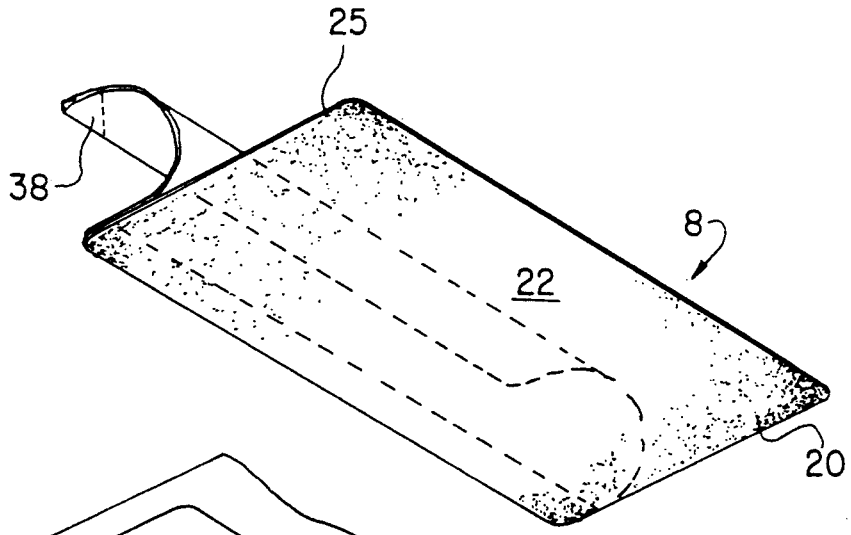
FIG. 2 is a perspective view of the underside of the label shown in FIG. 1 illustrating partial separation of the respective first and second label layers.

One embodiment of the multi-layer label in accordance with the subject invention, denoted generally by reference character 8, is depicted in FIGS. 1-4. In FIG. 1, the label 8 is shown mounted along a section of a continuous backing web 12. Although only one label 8 is shown, the backing web 12 extends laterally in either direction and provides a base upon which a plurality of labels 8 can optionally be mounted. The label 8 is constructed from a plurality of laminated sheets or layers. In the example depicted in FIG. 1, the label 8 includes two layers, the first layer 10 that is superposed over a lower layer 20, each of which is formed from a flexible printable material such as a plastic (polymer plastic) or paper. Further included on the label 8, is intelligible or printed matter 18, which may be included on the outer side 15 of layer 10, the inner side 28 of layer 10 (FIG. 3), and/or the outer surface 33 of layer 20. The intelligible or printed matter may be instructions, information, symbols, images, etc., depending on the requirements of the label. A registration mark or other form of machine-readable indicia 26 can be provided along the outer side 15 of layer 10. Although not as shown in FIG. 2, the inner surface 22 of layer 20 may also be provided with printed matter thereon if the label 8 is to be adhered to a translucent and/or transparent package made, for instance, of glass or plastic. The inner surface 28 of layer 10 is preferably uniformally coated with a pressure sensitive adhesive 24 which facilitates adhesion between layer 10 and layer 20. Likewise, layer 20 is coated with an adhesive 25 on its inner surface 22, as depicted in FIG. 2. There are a number of suitable pressure sensitive adhesives that may be used in the subject invention, among them being, acrylic, emulsion acrylic, hot melt or rubber base adhesive. However the most suitable adhesives are the pressure sensitive adhesives of the type manufactured by National Starch and Chemical Co., Bridgewater, N.J. and Morton Thiokol Co., Chicago, Ill. It should be noted that in the preferred embodiment, the adhesive 24 is a pressure sensitive adhesive. The adhesive 25 may be a pressure sensitive adhesive, but could alternatively be any adhesive prescribed by the needs of the manufacturer using the label 8 on his product. Further, the hinge portion 35 need not be positioned at one edge of the label 8 as shown in FIG. 1, but could also be positioned in the central portion of the label 8 such that two edges of layer 10 may be partially separated from the layer 20 exposing printed matter.

The layer 10 of the label 8 may optionally b provided with either perforations or scores 39 (FIG. 1) such that the portion defined by the dotted lines 39, may be completely separated from the label 8 if for instance, a discount coupon is printed on the inner surface 28 of the layer 10.

In a further embodiment, a tamper proof feature may also be provided with label 8 such that once a label is opened, evidence of the opening event remain in clear view. For instance, the adhesive release layer 30 coats all of layer 20 except the hinge region 35 and the regions designated by the numeral 41. In this embodiment, a relatively permanent bond is formed not only at the hinge portion 35 but also at portions 41. When the layer 10 is separated from layer 20, the regions 41 must be forced apart. One purpose for this feature is to insure that the layer 10 does not separate prematurely, for instance during shipping. Alternatively, the portions defined by numerals 41 may be further provided with perforations, such that portion 41 will remain adhered to the layer 20 after the layer 10 has been separated from the layer 20, leaving evidence of tampering after separation of the layer 10 from the layer 20.

Figure 3:
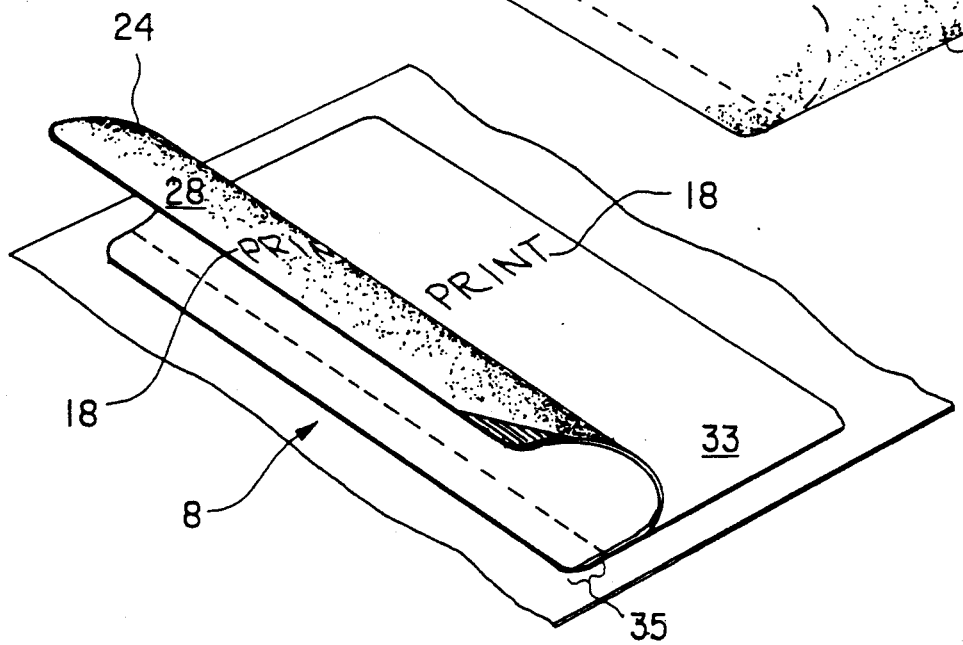
FIG. 3 is a top perspective view of the label of FIGS. 1 and 2 in a partially open or peeled back position.

Referring now specifically to FIGS. 3 and 4, the various arrangements of printed matter and adhesives that are provided along upper and lower layers 10 and 20 will now be described. As shown in FIG. 4, the lower layer 20 is coated with an adhesive layer 25 which, until the label is applied to an article of manufacture, retains the lower layer 20 against backing web 12. A portion of the outer surface 33 of lower layer 20 is treated with a release layer 30 which facilitates a releasable bond between the adhesive 24 on the inner surface of the layer 10 and the outer surface 33 of the layer 20 coated with the release layer 30. The release layer 30 may, for instance, include silicone. In the present embodiment, an ultra-violet (U.V.) curable silicone release layer is employed. Preferred silicone compounds for the release layer are those which are manufactured by General Electric., Co., Waterford, N.Y. and Goldschmidt Chemical Co., Hopewell, Va. The release layer 30 extends over all but a lateral edge portion 35 of the outer surface 33 of layer 20. The upper layer 10 is provided with an adhesive 24 extending along substantially the entirety of its inner surface 28. The upper and lower layers 10 and 20 are permanently bonded to one another by the adhesive 24 that is provided along the inner surface 28 and the lower layer portion 35, thus forming a hinge at portion 35. The release layer 30 allows for the upper layer 10 to be repeatedly separated or peeled back from the lower layer 20 and subsequently closed and reattached to lower layer 20, as shown in FIGS. 1 and 3. Corner 38 of the inner surface 28 of layer 10 includes an adhesive deadener coated over the adhesive 24 on the inner surface 28 of layer 10. The adhesive deadener that is applied to the corner 38 may be a varnish or other similar substance known in the art for reducing or "deadening" the adhesive bonding qualities of the adhesive 24. The provision of adhesive "deadener" at the corner 38 provides for the embodiment of a label lift tab for facilitating user grasping and separation of the layer 10 from the layer 20.

Alternatively, corner 38 may be defined by an area that has not been coated with adhesive, thus forming a lift tab. Further, the lift tab need not be located at a corner, but could also be along an edge depending on the needs of any specific application.

It should be appreciated that the word "permanent", as used herein, is a relative term. The bond formed in the region designated by the numeral 35 is a relatively permanent bond compared to the releasable bond between the adhesive 24 on the layer 10 and the release layer 30 on layer 20 of label 8. It is, of course, to be understood that layers 10 and 20 are likely completely separable from one another upon the application of a sufficiently great separation force. However, the label would, in all likelihood, be of no further use. Further, in label applications on, for instance, pharmaceuticals, where tamper proof packaging is desirable and in some cases required, the outer surface 33 of the layer 20 may include printed warnings (not shown) in the region 35 to warn the retailer and customer that tampering has occurred in the event that the layer 10 has been removed.

Figure 5B:
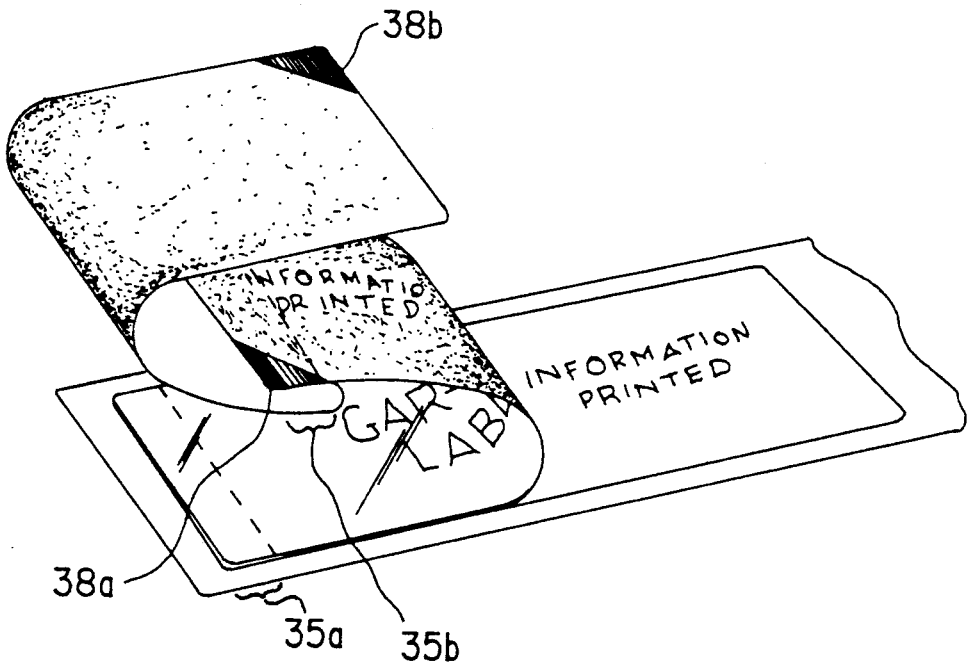
FIG. 5B is a top perspective view of an alternative embodiment of the present invention comprising three laminated layers, shown in a partially open position.

In an alternative embodiment of the present invention depicted in FIG. 5A, the label 8 includes a second upper layer 40 which is likewise superposed over layers 10 and 20 and is provided with a pressure sensitive adhesive that substantially uniformally coats its inner surface 45. An adhesive deadener may also be applied to the corners **38*a* and 38 of the second and first upper layers 40 and 10, respectively. An adhesive release material is applied to the outer surfaces 15 of layer 10 on all but the lateral edge portion 35 to facilitate a releasable bond between layer 40 and layer 10. Similarly, as depicted in FIG. 6, a four layer label may also be constructed that includes a third upper layer 43 which likewise has adhesive uniformally coating its inner surface 47 and corner 38*b* upon which the adhesive is "deadened" with an adhesive deadening material of the type described above. The layers 10 and 40 are likewise coated along their respective outer surfaces with an adhesive release material on all but their respective edge portions 35 to facilitate a releasable bond between the layers 10, 40 and 43. Printed matter may be printed on both the inner and outer surfaces of layers 40 and 43. Further, the hinge portion 35 need not be on common edges as shown in FIG. 5A. For example, as shown in FIG. 5B, the hinges 35*a* and 35*b* may be on opposite sides of the layer 10, with layer 10 being hinged to layer 20 at hinge 35*a* and layer 40 being hinged to layer 10 at hinge 35*b***.

As was mentioned above, the inner surfaces 22 and 28 of label layers 20 and 10, respectively, may be provided with printed matter 18. The printed matter 18 may be coated and/or printed directly onto the adhesive 24 of each of the layers 20, 10, 40 and 43. It should be noted that the printed matter may be applied to the appropriate surface prior to coating that surface with adhesive. In an alternative embodiment of the present invention, label 8 may have printed matter 18 applied in a different manner. For instance, label 8, as depicted in FIG. 7, may include an upper layer of clear plastic sheet material 50 that is provided with printed matter 52 in reverse to the outer surface thereof in order that it can be read from the inner surface of the layer 50. An adhesive 24 coat is provided to the inner surface of clear plastic layer 50. An opaque or white coating 55 overlies the printed matter 52 and the outer surface of the layer 50 such that the printed matter 52 cannot be read from the outer surface of layer 50 but can be read from the inner surface of layer 50. Printed matter 60 is applied to the opaque layer 55 such that printed matter 60 is readable from the outer surface of layer 50.

In yet another embodiment, depicted in FIG. 8, the lower layer 66 is provided with an adhesive 70 along both the inner and outer surfaces 22 and 33 of the layer 66. The inner surface of an upper layer 72 is selectively coated with an adhesive release layer 30 in a fashion similar to previous embodiments such that there is an uncoated portion 35. The adhesive 70 on the outer surface of the layer 66 contacts the uncoated portion 35 of the upper layer 72 to form a generally permanent bond, thereby providing a hinge for the label. The contact between the adhesive 70 on the upper surface of the lower layer 66 and the release layer 30 on the inner surface of the upper layer 72 forms a separable bond, thus allowing the upper layer 72 to be repeatedly separated and re-adhered to the lower layer. A lift tab can optionally be provided by coating a corner 74 of the adhesive 70 on the upper surface of the layer 66 with a varnish or other suitable adhesive "deadener" to diminish the bonding properties of the adhesive for the reasons described above.

The label upper layer 72 is formed from a clear or translucent material, the outer surface of which is provided with printed matter 75 in reverse, such that it is viewable from the inner surface of the upper layer 72. The outer surface of the upper layer 72 and the printed matter 75 is coated with an opaque coating 80 that can optionally be provided with printed matter 90 thereon. It should be noted that the printed matter 95 can optionally be provided on the adhesive 70 on the inner surface of the lower layer 66 in accordance with customer or user preference. Alternatively, the upper layer 72 is printed with printed matter in reverse on its inner surface such that the printed matter is read from the outer surface of the layer 72. The printed matter may then be coated with an opaque coating then printed matter, and lastly an adhesive release layer. However, it should be appreciated that the lower layer 66 dipicted in FIG. 8 could alternatively be used with an upper layer similar to the upper layer 10 described with reference to FIG. 4. If the layer 10 described with reference to FIG. 4 were used with the lower layer 66 of FIG. 8, then a release layer 30 would be substituted for the adhesive layer 30 on layer 10.

B. THE LABEL MANUFACTURING APPARATUS

Figure 9A:
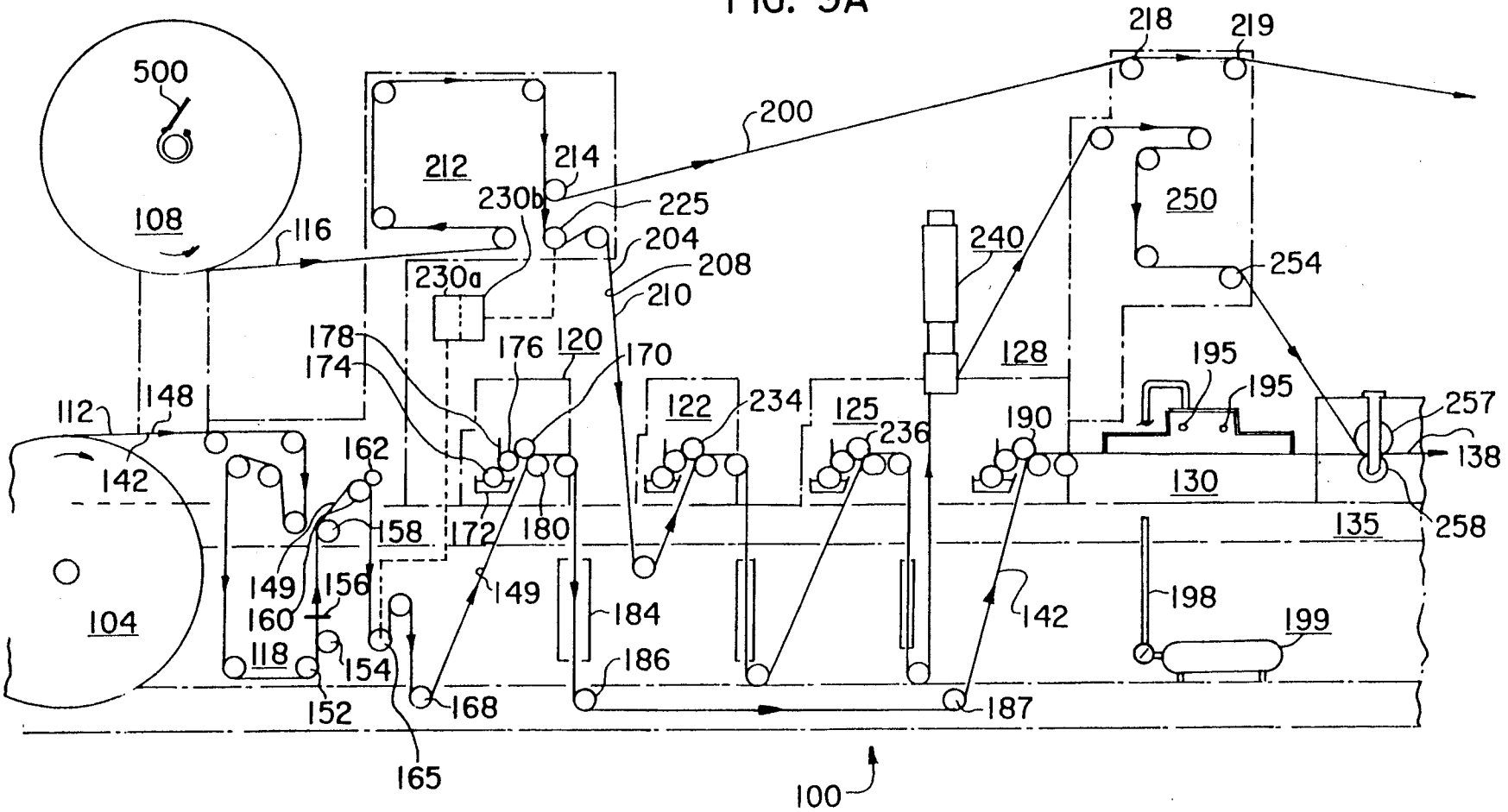
FIGS. 9A and 9B are schematic sideviews of one embodiment of the label manufacturing apparatus of the present invention.
Figure 9B:
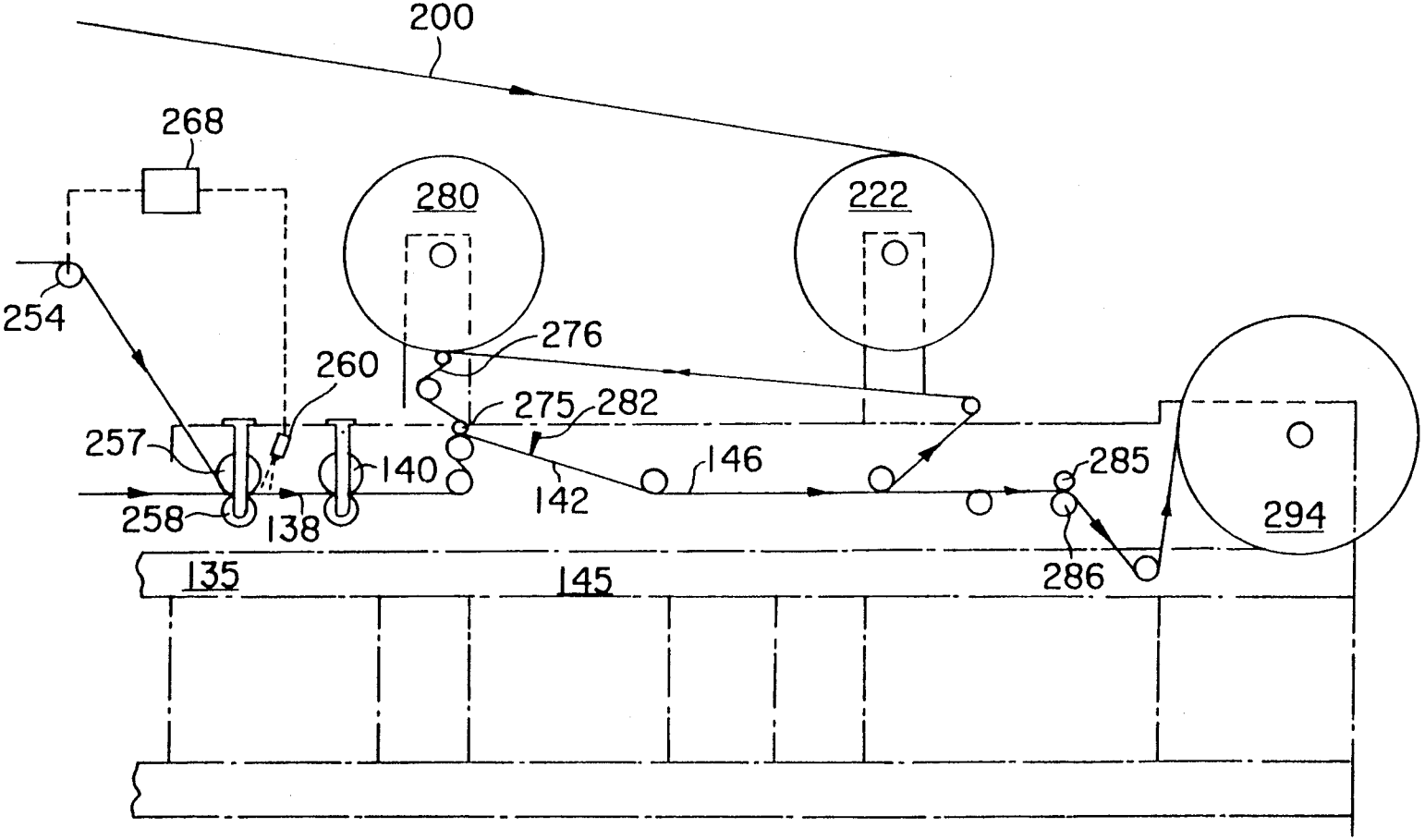

FIGS. 9A and 9B depict one embodiment of the label manufacturing apparatus 100 of the present invention. The apparatus 100 includes the following components:

web spools 104 and 108 which unroll feeding webs 112 and 116, respectively, into printing apparatus 100;

an unwind station 118 into which web 112 feeds;

a first printing station 120 which prints information onto web 112;

a second printing station 122 which prints information onto web 116;

a third printing station 125 which selectively coats a portion of web 116 with an adhesive deadening material;

a fourth printing station 128 which selectively coats adhesive release material onto one side of web 112;

a curing station 130 which cures the adhesive release material coated on web 112 in fourth printing station 128;

a lamination station 135 which laminates webs 112 and 116 together to form a composite web 138, and which further includes a die cutter 140 which die cuts composite web 138 into a plurality individual labels 8 but leaves the label on the backing web 142; and a trim cutting station 145 which accurately trims the outside edges of the composite web 138.

With continuing reference to FIGS. 9A and 9B, the first web 112 is fed into the label manufacturing apparatus 100 from spool 104, and enters unwind station 118. Web 112 typically includes two portions, the backing web 142 formed from release coated paper or plastic, and a layer of continuous material 148 having an upper surface 149. Web guide steering roll 152, used in conjunction with web guide dead bar 154 and web guide sensor head 156, is operable in a manner known in the web processing art to align the first web 112 as it progresses through the apparatus 100 along a path which is defined initially by idler roller 158. Power roller 160 and pressure nip roller 162 co-act to motivate the web 112 through the unwind station 118 and into other stations downstream in the apparatus 100.

A tension transducer idler 165 is positioned near the bottom of unwind station 118 and monitors the tension on the first web 112. The operation and feedback signals from tension transducer idler 165 will be explained further below. The first web 112 extends around idler roller 168 and into the first printing station 120, where a first print roller 170 such as a photopolymer roller is operable to apply ink to the outer side 149 of the first web 112. A number of suitable inks may be applied. For instance, water base inks, solvent inks, U.V. curable inks, hot melt or electron beam curable inks may be used such as those manufactured by General Printing Ink of Mansfield, Mass., Nobel Chemical Co., Langhorn, Pa., Croda Ink Co., Melvern, Pa., and Environmental Ink Co., Morganton, N.C. In the present embodiment, a solvent ink is supplied to reservoir tray 172. A rubber roller 174 transfers the ink from the reservoir tray 172 to a roller 176 from which excess ink is removed by the blade 178. The roller 176 transfers the ink to the print roller 170 for application to the outer surface 149 of the material 148 as the material passes between the print roller 170 and an impression steel roller 180. Similar printing arrangements and components are included in print stations 122, 125 and 128. The printing arrangement described herein is known in the art as flexography. However, it should be appreciated that there are a number of different printing process which could be employed. For instance, letter press printing, rotary screen, lithography, gravure or ink jet printing, etc., could easily be incorporated into the label manufacturing apparatus, as could other processes.

As the first web 112 leaves first print station 120, it enters dryer 184, where the applied ink is dried onto the outer side 149 of first web 112. Any suitable source of heat may be employed in the dryer 184 with for use with either waterbase inks or solvent inks. In the present embodiment, the dryer 184 is supplied with hot air from a remote source (not shown) which imparts heat in sufficient quantity to effect substantially complete drying of the ink prior to the web 112 exiting from the station. Following its exit from the dryer 184, the first web 112 passes under idler rollers 186 and 187, and in so doing bypasses second printing station 122 and third printing station 125. The web 112 extends around idler roller 187 and proceeds to the fourth printing station 128 where print roll 190 selectively prints a suitable adhesive release material such as silicone to the outer surface 149 of first web 112.

Details of the print roll 190 are shown in FIG. 11. With reference to the drawing, the outer surface 191 of the roll 190, with the exception of the recess 192, is operable to apply adhesive release material to web 112. The recess 192 is provided to ensure that region 35 of layer 20 is not coated with adhesive release material that is applied by the roller 190, thus allowing layer 10 to permanently bond to layer 20 at region 35 to form a hinge. Because the location of the hinge can be varied in accordance with the type of label that is to be produced, the roll is preferably interchangeably mounted to the apparatus 100 so as to permit the substitution and use of rolls 190 having appropriately configured and dimensioned recess areas 192 that allow for the fabrication of labels having the desired hinge configuration.

Referring again to FIGS. 9A and 9B, the first web 112 next enters the ultraviolet (UV) curing station 130. The adhesive release layer applied by print roll 190 to web 112 cures in ultraviolet curing station 130 in an inert atmosphere. In the present embodiment, the UV curing station 130 includes two ultraviolet lamps 195 and is in the form of a generally box-shaped, inverted structure to which at least one gas line 198 is attached. The gas line 198 is provided for the supply of a suitable inert gas, such as nitrogen, from a tank 199 to facilitate ultraviolet curing at station 130. After leaving ultraviolet curing station 130, web 112 passes to lamination station 135, where it is laminated to second web 116.

The second web 116 is supplied from roll 108 and includes a backing layer 200 to which the second sheet-like material 204 is adhered. In the preferred embodiment, the outer surface 208 of the layer 200 has a plurality of laterally spaced pre-printed areas which are subsequently processed in the manner described below so as to form the label 8 upper layers 10. The second web 116 is pre-printed with a registration mark (not shown) as is known in the art, that is indicative of the relative position of the print. The second web 116 also includes an inner surface 210 that is coated with an adhesive material which, upon web departure from roll 108, is releasably attached to the backing layer 200. The web 116 is advanced from roll 108 and enters a web guide station 212 where it is aligned in apparatus 100 in a fashion similar to that described above in connection with station 118. Web guide station 212 includes a roller 214 about which the backing web 200 is guided for separating the backing web 200 from the second web 116. The backing web 200 is directed above the apparatus 100 to rollers 218 and 219 which guide the backing web 200 toward a waste take-up reel 222. The web 116 wraps around tension transducer idler 225, which monitors the tension applied to web 116 in a similar fashion to the measurement of tension by tension transducer idler 165 described above. Tension monitoring units 230*a* & 230*b* are electrically coupled to tension transducer idlers 165 and 225 respectively and monitor the tension webs 112 and 116 respectively.

After exiting web guide station 212, the second web 116 enters second print station 122, where printed matter is applied to the inner surface 210 of the web 116 via the printing roll 234. Following its departure from the second print station 122, the web 116 is advanced to the third print station 125, where predetermined portions of the web are coated with an adhesive deadening material such as varnish by the print roller 236. The predetermined portions coated with adhesive deadening material subsequently become corners 38 (FIGS. 1–4) to serve as lift tabs for the label 8. After exiting the third print station 125, the web 116 proceeds to a conventional turn bar 240 (FIG. 9A and 10) which re-orients the web 116 such that its inner surface 210 is facing in a downward direction as the web 116 exits the turn bar 240 to prepare it for proper orientation for lamination with the web 112 in the lamination station 135.

The turn bar 240 (FIG. 10) includes an upper roller 241 which directs the web 116 to an angle bar 242 which is inclined at an angle of about 45° to the direction of web travel. Web 116 then travels to roller 243 and to second 45° angle bar 244. From bar 244, the web 116 exits turn bar 240.

The second web 116 moves from the turn bar 240, and passes through an alignment station 250 which includes the powered roll 254 whose function will be described further below. After passing over powered roll 254, the web 116 proceeds to the lamination station 135 where the second web 116 is laminated to the first web 112 via the pressure exerted upon the two webs 112 and 116 by the opposed rollers 257 and 258 to form a composite web, hereinafter referred to as web 138. The alignment of webs 112 and 116 during the lamination process will be explained further below.

A photoelectric eye 260 scans the composite web 138 for registration marks (not shown) in order to ascertain the relative position of second and first webs 116 and 112 as the now-laminated webs approach the cutting roller 140. Upon detection of the registion mark, the photoelectric eye 260 sends a suitable electric signal to register feedback unit 268 which, in turn, controls the speed of powered roller 254, thereby controlling the relative position of the web 116 as it approaches the die cutting roller 140.

Details of the die cutting roller 140 are shown in FIG. 12. The die cutting roller 140 includes a plurality of cutting edges 266 which are formed into the exterior surface 270 of the roller 140 in such a way as to permit for cutting through the composite web 138 but no through backing web 142. Web 138 passes from rollers 257 and 258, to cutting roller 140 and then to separation roller 275, where waste material 276 cut from the composite web 138 is fed to a waste take-up reel 280. After passing around separation roller 275, the composite web 138 proceeds to cutting station 145, where the composite web 138 is trimmed by the razors 282.

The web passes through power driven roller 285 and idler roller 286, after which the webs are wound onto take-up reel 294. Further, after the web 138 passes through cutting station 145, any further waste material is directed back to waste take up reel 280.

Figure 13:
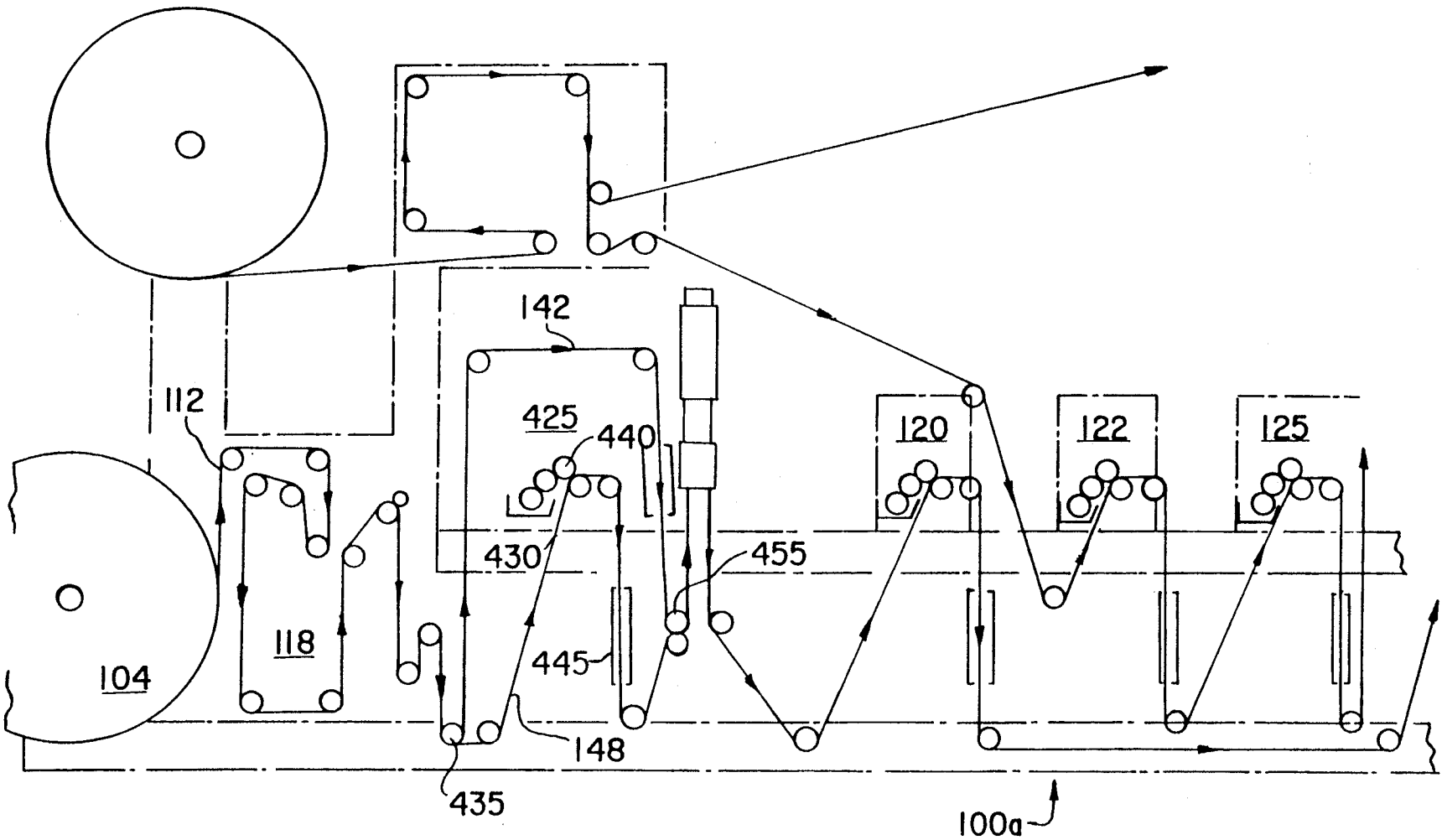
FIG. 13 is a schematic side view of a further embodiment of the apparatus of the present invention.

An alternative embodiment of the apparatus 100 is depicted in FIG. 13 and is denoted by reference number 100*a*, in which only the left-hand side (i.e., preliminary web processing stations) of the apparatus is depicted. The portions of the apparatus 100 depicted in FIG. 9B correspond to the portions of the apparatus 100*a* not shown in FIG. 13.

Referring now to FIG. 13, the web 112 is fed from the roll 104 into the unwind station 118 and proceeds to a print station 425 where the inner surface 430 of the web 112 is separated from the backing web 142 by roller 435. Printed matter is applied to the inner surface 430 by the print roller 440. The web 112 proceeds to the dryer 445 where the ink is dried in a fashion similar to that described above with the dryer 184. The web is then re-adhered to the backing web 142 at roller 455. The web 112 thereafter is turned over by turn bar 460 which is essentially the same as turn bar 240. The remaining portions of apparatus 100*a* are essentially the same as apparatus 100 in FIGS. 9A and 9B.

Referring again to FIG. 9A, yet another embodiment of the present invention is depicted. In this embodiment, label manufacturing apparatus 100 is loaded with a web 116 which includes a clear plastic material 204 adhered to the backing web 200. The clear plastic material 204 is pre-coated on its inner surface with adhesive and pre-printed along its outer surface as previously described with reference to FIG. 12. When using the pre-printed web as described with reference to FIG. 7, printing station 122 is not necessary and can therefore be deleted from the apparatus 100, as no printing is provided by that portion of the apparatus.

In yet another embodiment, web 112 is provided with adhesive along both the inner and outer surfaces, and the second web 116 includes the coatings as described with reference to FIG. 8. In this case, the apparatus 100 is arranged to accept the web 112 and the preprinted web 116, laminate them together, and cut them. In this embodiment, the print station 128 is provided with a varnish or other suitable adhesive deadening agent to print an adhesive deadening material to the corner 74 (FIG. 8) on the outer surface of adhesive 70 of the lower layer 66 thus creating a lift tab for separation of the layer 72 from the layer 66. The printing stations 122 and 125 (FIGS. 9A and 9B) would not actively participate in the process and would remain inactive.

It should also be understood that when one or more of the label layers is made of a relatively absorbent material such as paper, more ink, adhesive or adhesive release material will be required than when a plastic material like polyethylene is employed due to absorption by the layer material.

D. METHOD AND OPERATION OF APPARATUS

Printing machines such as those manufactured by Gallus Corp. of New Town, Pa., Kopack, Inc. of Bensenville, Ill., Webtron Corp. of Fort Lauterdale, Fla., Comco Corp. of New Twon Pa., and Mark Andy Corp. of St. Louis Mo., are generally known in the art and are readily modifiable for use in a number of printing applications. In the present invention, such machines can be modified to facilitate the printing and lamination of the respective layers into a finished label 8. As is generally known in the art, the print rollers 170, 234, 236 and 190, die cutting roller 140, and power roller 285 may be driven by a common powered shaft (not shown), thereby ensuring synchronous movement of each with respect to one another. The web 112 enters the machine 100 as a blank label which is to be subsequently printed with information thereon by the print roller 170 at the first print station 120. A suitable adhesive release material such as silicone is selectively applied to the web 112 by the print roller 190. Thus, because die cutting roller 140 and print rollers 170 and 190 have synchronous rotational movement, as long as the web 112 enters the print station 120 at a controlled rate, the die cutting roller 140 will cut labels 8 in registration with the printed information 18 and silicone release layer 30. In order to ensure that the web 112 enters the print station 120 at a controlled rate, the tension monitoring unit 230 controls the relative speed of the power roller 160 based upon the sensed tension on the web 112 by the tension roller 165.

As noted above, the relative position of the web 116 is monitored by the photoelectric eye 260, which sends signals indicative of the relative position of the web to a register feedback unit 268. The register feedback unit 268 is operable to manipulate the speed of the phase roller 254 in order to ensure alignment of the web 116 with die cutting roller 140, and hence alignment of the web 116 with web 112. Print rollers 234 and 236 and die cutting rollers 140 are all powered by the common shaft (not shown) and hence have synchronous rotational movement. Therefore, as long as web 116 enters print stations 122 and 125 at a controlled rate, the printed matter 18 applied to web 116, the registration mark and the adhesive deadening material applied to the corner 38 will be in registered position when superposed over the printed matter on web 112 at lamination station 135 and properly aligned by phase roller 254. To ensure that web 180 enters the printing apparatus 100 at a controlled rate, the tension monitoring unit 230 is operable to control a brake 500 which selectively retards rotational movement of the feed roll 108 based upon feedback from tension roller 225. It should be appreciated that other control systems could be used to align, in proper registration, the multiple webs prior to lamination. For instance, synchronous motors, or similar controlled motors, may be controlled by a control unit as an alternative to an apparatus with a single drive shaft powering each print station. Examples of such alternative control systems include those that are typically used in the magazine printing and apparatus assembly industries.

While the subject invention has been described in conjunction with various preferred embodiments, it is to be understood and appreciated that the protection to be afforded the invention is defined by the accompanying claims and functional equivalents thereof, rather than by the specific features of the foregoing detailed description and accompanying drawings.

What is claimed is:

1. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein all but a section adjacent to one edge of said first layer outer surface is coated with said adhesive release material, and wherein said section of said first layer allows for substantially permanent adhesion to a corresponding section of said inner surface of said second layer.

2. A label comprising:

at least two superposed webs, each of said webs having an inner surface and an outer surface;

a first of said webs having an adhesive applied to both inner and outer surfaces thereof;

a second of said webs having an inner surface selectively coated with an adhesive release material, a portion of said second web inner surface permanently attached to said first web outer surface and being releasably attachable to said first web in the portion coated with adhesive release material such that said first and second webs can be repeatedly separated and readhered to one another.

3. A label comprising:

at least two superposed webs, each of said webs having an inner surface and an outer surface;

a first of said webs having an adhesive applied to the inner surface thereof and having an outer surface selectively coated with an adhesive release material; and a second of said webs having an adhesive applied to the inner surface thereof, a portion of said second web inner surface permanently attached to said first web outer surface and being releasably attachable to said first web in the portion coated with adhesive release material such that said first and second webs can be repeatedly separated and readhered to one another.

4. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein a portion of the inner surface of said second layer is coated with an adhesive deadener for forming a lift tab at said corner.

5. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein each of said first and second layers includes first and second opposite ends, and wherein said second layer, when superposed upon said first layer, is substantially coextensive therewith so that said second layer first and second ends are in registered overlying relation to said first layer first and second ends, respectively.

6. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein said second layer comprises:

a translucent material, said outer surface being provided with intelligible matter such that said matter is viewable from said inner surface; and an opaque coating overlying said outer surface matter.

7. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein said second layer comprises:

a translucent material provided on said inner surface with intelligible matter such that said matter is viewable from said outer surface, said inner surface being further provided with an opaque coating overlying said inner surface printed matter; and a pressure sensitive adhesive further overlying said inner surface printed matter and said opaque coating.

8. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein said inner surface of said first layer is coated with an adhesive, and wherein said first layer is releasably secured to a backing web such that said label is detachable from said backing web for application to an article.

9. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein said label further comprises:

a third layer superposed on said second layer, an inner surface of said third layer being substantially permanently secured to said outer surface of said second layer at one end thereof and releasably securable to the remainder of said outer surface of said second layer.

10. A label for displaying intelligible matter, comprising:

a first layer having an inner surface and having an outer surface partially coated with an adhesive release material; and a second layer superposed upon said first layer, said second layer having an inner surface provided with a pressure sensitive adhesive along substantially the entirety of its surface and facing toward said outer surface of said first layer and being separable from at least a portion of said first layer so as to expose said first layer outer surface, wherein all but a section adjacent to a first edge of said outer surface of said first layer and at least one section of a second edge of said first layer outer surface are coated with said adhesive release material thus forming a hinge and a tamper proof region, respectively, of the label.

11. A label as set forth in claim 5 wherein said second layer is readily separable from said first layer from said first end toward sand second end thereof, said second layer being fixedly secured to said first layer at said second end thereof so as to bind together said first and second layers.

12. A label as set forth in claim 11 wherein said second layer inner surface is repeatedly securable to said first-layer outer surface following separation therefrom.

13. A label as set forth in claim 12 wherein said label is formed as two distinct sheet-like elements comprising said first and second layers secured together at said second ends thereof.

14. A label as set forth in claim 1, 2 or 3 wherein at least a portion of said label is comprised of a plastic material.

15. A label as set forth in claim 1, 2 or 3 wherein at least a portion of said label is comprised of paper.

16. A label as set forth in claim 6 wherein said opaque coating is provided with further matter viewable from said outer side.

17. A label as set forth in claim 16, wherein said matter provided on at least one of said surfaces is printed therein.

18. A label as set forth in claim 3 wherein all but a central portion of said outer surface of said first layer is coated with said adhesive release material, thereby defining a central label hinge.

19. A label as set forth in claim 1 wherein said inner surface of said first layer is coated with an adhesive.

20. A label as set forth in claim 9 wherein each of said layers is substantially permanently secured to the underlying layer along a common edge, thereby forming a hinged booklet.

21. A label as set forth in claim 9 wherein said label further comprises:

a fourth layer superposed on said third layer such that an inner surface of said fourth layer is substantially permanently secured to an outer surface of said third layer along one edge and releasably securable to the remainder of said outer surface of said third layer.

22. A label as set forth in claim 1 or 3 wherein said second layer is printed with intelligible matter on said inner surface adhesive.

23. A label as set forth in claim 1, 2 or 3 wherein said second layer is printed with intelligible matter on an outer surface.

24. A label as set forth in claim 1 wherein said first layer is printed with intelligible matter on said inner surface.

25. A label as set forth in claim 1 wherein said first layer inner surface is provided with intelligible matter.

26. A label as set forth in claim 1, 2 or 3 wherein said second layer further includes a perforation line for facilitating detachment of a portion of said second layer.

27. A label as set forth in claim 1, 2 or 3 wherein said second layer further includes at least one score line for facilitating detachment of a portion of said second layer.

28. A label as set forth in claim 1, 2 or 3 wherein said second layer further includes at least one die cut for facilitating detachment of a portion of said second layer.

29. A label as set forth in claim 1 or 3 wherein said second layer inner surface is provided with printed matter between the inner surface and said adhesive.

30. A label as set forth in claim 2 wherein said second web further comprises:

a translucent material coated on said inner surface with intelligible matter such that said matter is viewable from said outer surface;

an opaque coating overlying said inner surface; and an adhesive release material overlying a preselected portion of said inner surface.

31. A label as set forth in claim 2 wherein said opaque coating is printed with further intelligible matter viewable from said outer surface and then selectively coated with said adhesive release material.

32. A label as set forth in claim 2 wherein said second web comprises:

a translucent material selectively coated on said inner surface with said adhesive release material and coated on said outer surface with printed matter printed in reverse such that said printed matter is viewable from said inner surface, said outer surface being further coated with an opaque coating such that said printed matter is not viewable from said outer surface.

33. A label as set forth in claim 32 wherein said opaque coating is printed with further intelligible matter readable from said outer side.

34. A label as set forth in claim 2 wherein said label further comprises:

a third web superposed on said second web, an inner surface of said third layer being substantially permanently secured to said outer surface of said second web at one portion thereof and releasably securable to the remainder of said outer surface of said second web.

35. A label as set forth in claim 33 wherein said label further comprises:

a fourth web superposed on said third web such that an inner surface of said fourth web is substantially permanently secured to an outer surface of said third web at one portion and releasably securable to the remainder of said outer surface of said third web.

36. A label as set forth in claim 2 wherein said second web inner surface is provided with printed matter between the inner surface and said adhesive release material.

37. A label as set forth in claim 2 wherein said first web surfaces are provided with printed matter between the surface and said adhesive.

* * * * *